US011293104B2

(12) United States Patent
Church

(10) Patent No.: US 11,293,104 B2
(45) Date of Patent: Apr. 5, 2022

(54) INORGANIC NON-CHROME AQUEOUS TREATMENT COMPOSITION AND PROCESS FOR COATING METAL SURFACES

(71) Applicant: Bulk Chemicals, Inc., Reading, PA (US)

(72) Inventor: Richard J. Church, Myerstown, PA (US)

(73) Assignee: BULK CHEMICALS, INC., Reading, PA (US)

( * ) Notice: Subject to any disclaimer, the term of this patent is extended or adjusted under 35 U.S.C. 154(b) by 723 days.

(21) Appl. No.: 16/014,045

(22) Filed: Jun. 21, 2018

(65) Prior Publication Data

US 2018/0371622 A1 Dec. 27, 2018

Related U.S. Application Data

(60) Provisional application No. 62/525,395, filed on Jun. 27, 2017.

(51) Int. Cl.

| | |
|---|---|
| ***C23C 22/44*** | (2006.01) |
| ***C23C 22/74*** | (2006.01) |
| *C23C 22/00* | (2006.01) |
| *C23C 22/76* | (2006.01) |

(52) U.S. Cl.

CPC ..... *C23C 22/44* (2013.01); *C23C 22/74* (2013.01); *C23C 22/76* (2013.01)

(58) Field of Classification Search

CPC ..... C23C 22/34; C23C 22/40; C23C 22/44

See application file for complete search history.

(56) References Cited

U.S. PATENT DOCUMENTS

| | | | | |
|---|---|---|---|---|
| 5,859,106 | A | 1/1999 | Jones et al. | |
| 8,728,251 | B2 | 5/2014 | Greber | |
| 2003/0051773 | A1 | 3/2003 | Dolan | |
| 2007/0068602 | A1 | 3/2007 | Pemberton et al. | |
| 2008/0280046 | A1 | 11/2008 | Brydan et al. | |
| 2011/0132497 | A1* | 6/2011 | Greber | C23C 22/44 148/247 |
| 2014/0223740 | A1 | 8/2014 | Matsui et al. | |

FOREIGN PATENT DOCUMENTS

| | | |
|---|---|---|
| CN | 101580654 | 11/2009 |
| CN | 102766862 | 11/2013 |
| DE | 102009044821 | 6/2011 |
| JP | 2014101585 | 6/2014 |
| TW | 506996 | 10/2002 |
| WO | 0228550 | 4/2002 |

OTHER PUBLICATIONS

International Search Report for International Application No. PCT/US2018/039255 dated Oct. 2, 2018.

Chinese Search Report dated Aug. 19, 2021 received in counterpart Chinese Application No. 201880042615.7.

* cited by examiner

*Primary Examiner* — Lois L Zheng

(74) *Attorney, Agent, or Firm* — Stradley Ronon Stevens & Young, LLP

(57) ABSTRACT

A chromium-free aqueous treatment solution for coating metal surfaces which meets corrosion resistance, electrical contact resistance, and paint adhesion requirements set forth in MIL-DTL-81706B, Class 3. The treatment solution contains a compound of a Group IV-B element, and a vanadium ion. The solution may be inorganic and molybdate-free.

15 Claims, No Drawings

INORGANIC NON-CHROME AQUEOUS TREATMENT COMPOSITION AND PROCESS FOR COATING METAL SURFACES

RELATED APPLICATIONS

This application claims the benefit of priority to U.S. Provisional Patent Application Ser. No. 62/525,395, filed on Jun. 27, 2017, the contents of which are incorporated in this application by reference.

TECHNICAL FIELD

The present invention relates generally to a chromium-free aqueous treatment solution for coating metal surfaces and, more particularly, to an inorganic solution which does not contain molybdate ions.

BACKGROUND OF THE INVENTION

Metals may be attacked by corrosive agents that are present in the environments in which the metals operate. For example, aluminum articles operating in a salt-containing environment may be attacked at their surfaces either generally over a large area or locally in limited areas, for example at weld joints, at bolt holes, or at small inclusions or pits in the surface. The corrosion damage increases over time and with continued exposure to the salt. Such corrosion could potentially lead to a premature failure of the article.

Coatings are widely employed to protect surfaces against such corrosion damage. In the past, chromium-containing passivating layers were used predominately to prevent the corrosion of metallic materials. Specifically, hexavalent chromium was used. Although conversion-coating techniques using hexavalent chromium provided satisfactory results, hexavalent chromium is toxic to the environment and a designated carcinogen. In an attempt to mitigate the societal risks associated with hexavalent chromium, the use of a trivalent chromate conversion coating, which is less toxic, has been employed.

Trivalent chromium, however, is not without its risks. During passivation of metal articles with trivalent chromate conversion coatings, the possibility exists for cross-contamination with hexavalent chromium and/or interconversion of trivalent chromium, such as by air oxidation of residual trivalent chromium. Therefore, the presence of toxic hexavalent chromium still may persist despite the alternate use of trivalent chromium in chromate conversion coating processes.

These disadvantages of passivating layers based on chromium led to intensive efforts to develop chromium-free corrosion inhibitors. For example, the owner of the present application has commercialized products that are successful in improving the corrosion resistance and paint adhesion of metal surfaces. Examples of such compositions are disclosed in U.S. Pat. No. 5,859,106 to Jones et al. and U.S. Pat. No. 8,728,251 to Greber. Both are directed to aqueous compositions including a polymer system having carboxylic functional groups and hydroxyl groups and a compound of a group IV-B element. Both contain organic compounds and molybdate ions, however, which increases the cost and the complexity with regard to disposal of the product.

Molybdate ions are non-toxic and are less aggressive oxidants than chromates toward organic additives that may be used in corrosion-inhibiting formulations. A prime application is in cooling water in air-conditioning and heating systems to protect mild steel used in their construction. Molybdates are used to inhibit corrosion in water-based hydraulic systems and in automobile engine anti-freeze. Molybdate prevents corrosion through its ability to be adsorbed by a metal oxide layer, filling gaps and so promoting the formation of an adherent oxide layer. Corrosion of the underlying substrate is prevented as it becomes passivated.

The search for passivating layers is further complicated by the fact that the passivating layer must have a coloration. Color is required in order for an operator to be able to check the production in industrial use quickly, simply, and visually. Such a visual check makes it possible to evaluate the quality of the coating without an expensive testing method.

In an attempt to standardize the evaluation of different passivating layers for government procurement purposes, the U.S. Department of Defense has published specifications outlining requirements that must be met for any composition if the supplier wants to sell their product to the government, or be part of any government contract. For coating aluminum surfaces (i.e., airplane parts), MIL-DTL-81706B provides the standards that must be met. Failure to meet corrosion resistance, electrical contact resistance, and paint adhesion requirements set forth in MIL-DTL-81706B restricts the potential market for a coating because certain non-governmental purchasers have also begun to require that coatings satisfy the requirements set forth in MIL-DTL-81706B.

Thus, there is a need for a low cost, chromium-free coating composition for coating metallic surfaces, which brings about sufficient protection to meet the requirements of MIL-DTL-81706B and, in addition, produces coloration on the metal surface, which can be visually verified.

BRIEF SUMMARY OF THE INVENTION

To meet these and other needs, and in view of its purposes, a low-cost, chromium-free, aqueous treatment solution for coating metal surfaces is provided. The solution brings about sufficient protection to meet the requirements of MIL-DTL-81706B, Class 3 and, in addition, produces coloration on the metal surface, which can be visually verified. The compositions of the present invention may be used to passivate the surface, improve paint adhesion, and/or improve corrosion resistance of metal surfaces. The composition may also be used as a pre-paint treatment for a range of metals including alloys of copper, brass, magnesium, aluminum, and iron.

In one embodiment, an inorganic chromium-free, molybdate-free, aqueous treatment solution comprises: water, a compound of a Group IV-B element, a vanadium ion and optionally stabilizing agents wherein the composition has a pH greater than or equal to 3.

In another embodiment, the present invention encompasses processes for treating a metal surface by contacting the metal surface with an inorganic chromium-free, molybdate-free, aqueous treatment composition comprising water, a compound of a Group IV-B element, and a vanadium ion. The processes may additionally comprise, before the first contacting step, the step of cleaning the metal surface with an aqueous silicated cleaner and rinsing. The processes may further comprise, after contacting the metal surface with the pretreatment composition, the steps of rinsing the metal surface with water and then painting the surface of the metal.

The processes may additionally comprise, before the first contacting step, the step of cleaning the metal surface with an aqueous silicated cleaner and rinsing. The processes may further comprise, after contacting the metal surface with the pretreatment composition, the steps of rinsing the metal surface with water and then painting the surface of the metal. The pH of the aqueous pretreatment composition comprising water, a compound of a Group IV-B element, a vanadium ion and optionally stabilizing agents, wherein the composition has a pH that is in some embodiments greater than or equal to 3.

DETAILED DESCRIPTION OF THE INVENTION

As used in this document, the term "pretreatment composition" means any composition which improves the paint adhesion and corrosion resistance of a metal surface. Aqueous pretreatment compositions are used as a pretreatment before painting and may be used as a passivation treatment to reduce the formation of corrosion in the uncoated (unpainted) condition. Thus, although the composition may be called a pretreatment composition for convenience, it is a composition used for pretreatment (i.e., improving the adhesion of subsequently applied paint) and passivation (i.e., resisting corrosion of the unpainted surface).

As used in this document, the term "treating" shall mean applying a treatment, or cleaning, rinsing, and applying a pretreatment. The pretreatment also functions as a sealant to seal the metal surface, so the term "treating" shall optionally include the step of sealing the metal surface. Further, "treating" optionally can include process steps up through and including painting. For example, treatment steps may also include a step of applying a decorative coating, such as painting by electrocoating. After applying the pretreatment, the pretreatment may be rinsed first or dried-in-place before application of the paint. Each of these steps play a role in a final product's ability to resist corrosion and minimize paint loss. As mentioned above, the treatment composition can be used as a pre-paint treatment without the use of chromium.

As used in this document, the term "metal," used for example in the phrase "metal surface," includes aluminum, iron, zinc, and combinations thereof. Each metal listed includes both the elemental metal and alloys thereof; for example, the term "aluminum" means aluminum and aluminum alloys. The term "alloy" is a metal in which the primary metal has the highest content of every other element or a content equal to the highest content of every other element, (e.g. an aluminum alloy being a metal in which aluminum is present in an amount at least equal to that of any other element). Iron alloys include cold rolled steel, electrogalvanized steel, and hot-dipped galvanized steel. In some embodiments, compositions of the present invention are used to treat a range of metals including alloys of copper, brass, magnesium, aluminum, and iron.

As used in this document, the term "compound of a group IV-B element" means an acid and/or a salt of a group IV-B element, as described in U.S. Pat. No. 5,859,106 to Jones et al., incorporated herein by reference. Such acids include fluorozirconic acid ($H_2ZrF_6$), fluorotitanic acid ($H_2TiF_6$), and fluorohafnic acid ($H_2HfF_6$). An exemplary salt of a Group IV-B element is ammonium zirconium carbonate. Without being bound by any particular theory or explanation, it appears that the group IV-B element, such as zirconium, increases the interaction between the composition and the metal surface, in effect helping to bond the composition to the metal surface.

The compositions may additionally include constituents that do not affect the basic and novel characteristics of the compositions. For example, a stabilizing agent may be added to improve the shelf-life and stability of the compositions. Stabilizing agents, such as ammonium biborate, may be particularly useful for this purpose. Without being held to the theory, it is believed that the stabilizing agent ties up free fluoride and buffers the solution, which prevents the reaction of the free fluoride with other elements in the solution. Components such as, for example, stabilizing agents may be added to the compositions without affecting the basic and novel characteristics.

The concentrations of the constituents of the compositions, as well as the application temperature and residence time, can vary over a wide range and can be modified in a known manner, depending on the desired coating weight. In addition, the desired coating weight will be a function of the type of metal, the timing of processing after application of the pretreatment, the environmental conditions to which the treated metal is exposed, and the type of decorative coating used, among other factors. The coating process can be effected by spray, immersion, or flow coating techniques. The amount of coating should be sufficient to achieve the desired characteristics of the dried metal for its intended use. The amount of coating desired is from about 1.0 to 40.0 milligrams of the dried coating per each square foot of dried metal surface. By using a solution of higher concentrations, it is possible to leave the desired amount of the dried coating with shorter treatment times and/or lower temperatures.

Component concentrations of a working bath of the present metal pretreatment can vary over a wide range. Appropriate concentration ranges of the various components are primarily dependent upon their solubilities. Above the solubility limits, the solute may begin to come out of the solution. At concentrations too low, there are insufficient amounts of the constituents to achieve the desired coating weight in a reasonable time and to perform their functions. Additionally, while these compositions may be provided as a concentrate, they are generally utilized as a dilution with distilled water.

In an embodiment of the invention in which the compound of a group IV-B element is a combination of 45% fluorozirconic acid and 60% fluorotitanic acid, and the vanadate ion is ammonium vanadate, the following ranges have been used: about 0.01 to about 5.99 wt % of fluorozirconic acid (as $H_2ZrF_6$); about 0.01 to about 5.99 wt % of fluorotitanic acid (as $H_2TiF_6$); and from about $1.0\times10^{-4}$ to about $5.0\times10^{-1}$ wt % ammonium vanadate. In some embodiments, the ranges are: 2.0 to 4.0 wt % of fluorozirconic acid (as $H_2ZrF_6$); 1.25 to 3.25 wt % of fluorotitanic acid (as $H_2TiF_6$); and from $1.0\times10^{-1}$ to $4.0\times10^{-1}$ wt % ammonium vanadate. The compositions given above are of the concentrate. It is desirable, of course, to ship the product in the form of a concentrate. The working bath will be created by diluting the concentrate with a diluent (e.g., de-ionized water). The concentration of the working bath will be between about 1% to about 10% of the concentrate. In some embodiments, the concentration of the working bath will be between about 2% to about 3% of the concentrate. In some embodiments, the concentration of the working bath will be 2% of the concentrate.

The pH of the present metal treatments can vary over a wide range, as mentioned above. The pH of the compositions of the present invention, such as the composition consisting of: water, a combination of a fluorozirconic acid and a fluorotitanic acid, and a vanadium ion is in the range greater than or equal to 3. Specifically, the pH of the composition may be in the range of about 3 to about 6. In other embodiments, the pH may be in the range of about 3 to about 5. In further embodiments, the pH may be in the range of about 3 to about 4.5. In other embodiments, the pH may be in the range from about 3.8 to about 4.2.

Here, the present metal treatment contains, if any, undetectable traces of molybdate ions. Although conventional wisdom suggests that molybdate ions improve corrosion resistance, as will be outlined below, with regard to the neutral salt spray test outlined in MIL-DTL-81706B, Class 3 this is not the case. Such a failure is believed to be the result of the hydration of the molybdate ion in the oxide layer by the sodium ions and water in the neutral salt spray. Under these conditions, the molybdate ion is removed from the oxide layer to form sodium molybdate. This formation results in a gap in the oxide layer. Corrosive agents may pass through this gap and attack the metal underneath the oxide layer. As outlined below, solutions that are molybdate-free pass the neutral salt spray test outlined in MIL-DTL-81706B, Class 3. Solutions that contain molybdate do not.

The present metal treatment is also inorganic. As a result, it does not contain aromatic carboxylic acid, specifically, gallic acid. The reason for this exclusion is because during the post treatment rinse the gallic acid is washed away and does not remain on the surface (i.e., it is wasted). Furthermore, when no post-treatment rinse is employed and a dry-in-place approach is utilized, the appearance of the coat is less uniform. Non-uniform coverage of the coat is undesirable because it results in non-uniform coverage of any paint that is subsequently applied.

Compositions according to the invention may be made by mixing the ingredients in any of a number of sequences. The order of addition of the constituents is not critical. In one embodiment, the vanadium ion is added to water before the acid of Group IV-B element. In an embodiment which includes a stabilizing agent, the stabilizing agent is added to water first, then the vanadium ion is added to that solution, and finally the acid of Group IV-B element is added to that solution. This is typically done all as a concentrate, so the concentrate is diluted at the metal treatment site prior to use.

Treatment of metal surfaces according to the invention typically includes contacting the metal surface with an aqueous pretreatment composition consisting essentially of water, a vanadium ion, a compound of a Group IV-B element, and optionally stabilizing agents, wherein the composition has a pH greater than or equal to 3. The processes may additionally include, before the rinsing step, the step of cleaning the metal surface with an aqueous cleaner and rinsing. The processes may further include, after contacting the metal surface with the aqueous pretreatment composition, the steps of rinsing the metal surface with water and then painting the surface of the metal. Alternatively, the pretreatment composition may be dried-in-place (i.e., not rinsed), then painted.

Contacting of the metal surface may be performed by any known coating technique, including for example spraying, immersing, roll coating, or flow coating. Optionally, after contacting the rinsed metal surface with a composition comprising a vanadium ion, and a compound of a group IV-B element, the metal surface is dried and then a decorative coating (e.g., paint) is applied, without rinsing between these steps. Thus, the pretreatment is a "dried-in-place" pretreatment in this embodiment.

The cleaning step removes oil and other contaminants from the surface of the metal, and is typically effected by immersing the metal surface in a bath of a silicated alkaline cleaning solution to form a cleaned metal surface. The silicated alkaline cleaning solution may be an aqueous solution of a silicated alkaline cleaning agent. Such a silicated alkaline cleaning solution is sold by Bulk Chemicals Inc., Reading, Pennsylvania, under the brand name Bulk Kleen®. Some exemplary silicated alkaline cleaning agents which can be used according to the present invention include sodium carbonate, sodium hydroxide, and potassium hydroxide. In one embodiment, the cleaner will be a silicated, alkaline, and non-etching cleaner. The cleaner should not be an acidic cleaner as such a cleaner will etch the metal. The use of an acid cleaner will result in failing salt spray results. It is believed that such a failure is caused by the acid cleaner exposing alloy elements or depositing material on the metal surface which increase the likelihood of corrosion. In some cases, cleaning may not be required at all, and this step may be omitted.

A metal surface which has been contacted by a silicated alkaline cleaning solution is called a "cleaned metal surface." It is cleaned in the sense that it has been exposed to the silicated alkaline cleaning solution. It is not completely free of contaminants, however, inasmuch as vestiges of the bath and other impurities may remain. Only after it is rinsed with water can it be viewed as fully cleaned and ready to make contact with a pretreatment composition (i.e., substantially all of the impurities are, by that point, removed). The rinsing step is a conventional water rinsing step, in one embodiment using deionized water, to remove any excess cleaner or detergent left on the metal surface from the cleaning step. The use of deionized water avoids the introduction of any deleterious ions, such as chloride ions, into the system. After the metal surface is rinsed, it is treated with an aqueous composition of the sort described above according to the invention.

One coating technique is reverse roll coating, whereby a sheet of metal is pulled between counter-rotating cylinders, which are rotating against the direction of travel of the sheet being unrolled. The solution is rolled down along these cylinders until it contacts the metal. As the sheet metal is passed between the cylinders in a direction against the direction of rotation of the cylinders, some wiping force is applied to the metal. Another conventional method is known as the quick-dip method, whereby sheet metal is dipped into a batch containing the coating composition and is subsequently passed between two rolls to remove the excess. The concentration, temperature, and pH of the bath are interrelated. In one embodiment, the bath temperature during this contacting step is about 70° F. to about 150° F., although the temperature can vary over a wide range depending on concentration and pH. The bath pH depends on the particular pretreatment composition used.

After pretreatment, the metal may then be dried (e.g., by blown air or by an oven). The temperatures for the drying operation may range from about 60° F. to about 500° F. The length of the drying step will depend upon the temperature utilized. In addition, air may be blown over the metal to enhance the evaporation.

The desirable performance characteristics of the present invention can be achieved by the processing steps described above to produce a pretreated metal surface with good paint adhesion and corrosion resistance. These characteristics are obtained on the metal surface without a decorative coating. Accordingly, the treated metal surface can be used as unpainted products and will exhibit corrosion resistance even if there is a delay between the treatment steps and any subsequent painting.

A decorative paint coating may be applied to the dried metal surface. Typical non-limiting examples of decorative coatings include paints and lacquers, including electrocoated paints. Suitable paints are available from a number of vendors. A top coat may be applied to the treated metal surface, either as a treated surface or as a treated and painted surface. For example, a suitable polyester triglycidyl isocyanurate (TGIC) powder coating top coat is sold by DuPont of Wilmington, Del., under the tradename Alesta® AR. Typically, no rinsing is performed after contacting the rinsed metal surface with the treatment composition and application of the decorative coating. In this way, the generation of waste is minimized. The dried-in-place composition of the present invention serves to adhere the paint or lacquer to the metal and to minimize corrosion.

The methods and compositions of the present invention can be applied in a wide variety of applications. These applications include, as non-limiting examples, extrusion applications and coil coating.

In sum, the present invention provides environmentally friendly compositions and processes for treating metal, while still maintaining excellent paint adhesion and corrosion resistance. More particularly, the present invention avoids the use of chromium (both trivalent and hexavalent chromium), and its associated health hazards and disposal problems. Furthermore, as will be outlined below, contrary to industry belief, adding molybdate compounds does not appear to offer any advantage and compounds containing molybdate consistently fail the neutral salt spray test under MIL-DTL-81706B, Class 3.

The compositions and processes of the present invention provide these benefits without the use of additional components which effect the basic and novel characteristics of the invention. Other components, when added to the composition in sufficient amounts, may affect the novel characteristics. For example, certain components may make the compositions unstable. Such components may cause the solution to polymerize and affect the shelf-life of the treatment. Other components may degrade the performance of the compositions and processes of the present invention.

EXAMPLES

The following examples are included to more clearly demonstrate the overall nature of the invention. Examples 1-15 illustrate the improved results obtained by employing aqueous compositions of this invention. These examples are exemplary, not restrictive, of the invention.

In all the below examples, Comp. 1, Comp. 2, Comp. 3, Comp. 4, Comp. 5, and Comp 6 refer to the solutions identified in Table 1 above.

Example 1—Comp. 1

In Example 1, 6061 alloy aluminum panels were treated via the following immersion process. First, the panels were cleaned with a 3% v/v treatment of Bulk Kleen® 842 for 3 minutes at 140° F. Bulk Kleen® 842 is a lightly silicated alkaline cleaner that will etch aluminum. Second, the panels were rinsed at ambient temperature for 30 seconds. Third, the panels were rinsed with deionized water at ambient temperature for an additional 30 seconds. Fourth, the panels were immersed at ambient temperature in a 3% v/v dilution of Comp. 1 with the bath pH adjusted to 3.5 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels failed to meet the requirements of MIL-DTL-81706B.

Example 2—Comp. 1

In Example 2, 6061 alloy aluminum panels were treated via the following immersion process. First, the panels were cleaned with a 4.5% v/v treatment of Bulk Kleen® 686QC for 2.5 minutes at 140° F. Bulk Kleen® 686QC is an aggressive acidic cleaner. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 1 in separate baths with individual bath pHs adjusted to 3.0, 3.5, and 4.0 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels failed to meet the requirements of MIL-DTL-81706B.

Example 3—Comp. 1

In Example 3, 6061 alloy aluminum panels were treated via the following immersion process. First, the panels were cleaned with a 15 g/L treatment of Bulk Kleen® 737G for

TABLE 1

Composition of the treatment solutions used (in % by weight based on the total weight of the concentrate of the treatment solution)

| | Comp. 1 | Comp. 2 | Comp. 3 | Comp. 4 | Comp. 5 | Comp. 6 |
|---|---|---|---|---|---|---|
| DI Water | 93.95% | 93.95% | 93.95% | 94.15% | 94.55% | 96.80% |
| 60% H2TiF6 | 2.25% | 2.25% | 2.25% | 2.25% | 2.25% | 0.00% |
| 45% H2ZrF6 | 3.00% | 3.00% | 3.00% | 3.00% | 3.00% | 3.00% |
| Gallic Acid | 0.40% | 0.40% | 0.40% | 0.40% | 0.00% | 0.00% |
| Ammonium Metavandate | 0.20% | 0.20% | 0.20% | 0.20% | 0.20% | 0.20% |
| Ammonium Dimolybdate | 0.20% | 0.00% | 0.00% | 0.00% | 0.00% | 0.00% |
| Ammonium Heptamolybdate | 0.00% | 0.20% | 0.00% | 0.00% | 0.00% | 0.00% |
| Sodium Molybdate | 0.00% | 0.00% | 0.20% | 0.00% | 0.00% | 0.00% |

5 minutes at 135-140° F. Bulk Kleen® 737G is a non-etching silicated alkaline cleaner. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 1 in separate baths with individual bath pHs adjusted to 3.0 and 4.0 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels failed to meet the requirements of MIL-DTL-81706B.

Example 4—Comp. 2

In Example 4, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 2 in separate baths with individual bath pHs adjusted to 3.0 and 4.0 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels failed to meet the requirements of MIL-DTL-81706B.

Example 5—Comp. 3

In Example 5, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 3 in separate baths with individual bath pHs adjusted to 3.0 and 4.0 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels failed to meet the requirements of MIL-DTL-81706B.

Example 6—Comp. 4

In Example 6, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 4 in separate baths with individual bath pHs adjusted to 3.0 and 4.0 with Bulk Neutralizer® 10 for 3 minutes. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels met the requirements of MIL-DTL-81706B, Class 3 (i.e., no pitting was observed).

Example 7—Comp. 4

In Example 7, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 4 in separate baths for either 3 minutes or 5 minutes with the individual bath pHs adjusted to 4.0 with Bulk Neutralizer® 10. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels met the requirements of MIL-DTL-81706B, Class 3 (i.e., no pitting was observed). In addition, all panels passed the wet tape adhesion test per MIL-DTL-81706B, Class 3.

Example 8—Comp. 5

In Example 8, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 5 in separate baths for either 3 minutes or 5 minutes with the individual bath pHs adjusted to 4.0 with Bulk Neutralizer® 10. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels met the requirements of MIL-DTL-81706B, Class 3 (i.e., no pitting was observed). In addition, all panels passed the wet tape adhesion test per MIL-DTL-81706B, Class 3.

Example 9—Comp. 4

In Example 9, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 4 in separate baths for either 3 minutes or 5 minutes with the individual bath pHs adjusted to 4.0 with Bulk Neutralizer® 10. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels met the requirements of MIL-DTL-81706B, Class 3 (i.e., no pitting was observed). In addition, all panels passed the wet tape adhesion test per MIL-DTL-81706B, Class 3.

Example 10—Comp. 5

In Example 10, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 5 in separate baths for either 3 minutes or 5 minutes with the individual bath pHs adjusted to 4.0 with Bulk Neutralizer® 10. Fifth, the panels were rinsed at ambient temperature with deionized water for 10 seconds. Sixth, the panels were dried for 5 to 10 minutes at temperatures ranging between 200-220° F. Seventh, all panels were exposed unpainted to 168 hours of neutral salt spray per ASTM B117. All panels met the requirements of MIL-DTL-81706B, Class 3 (i.e., no pitting was observed). In addition, all panels passed the wet tape adhesion test per MIL-DTL-81706B, Class 3.

Example 11—Comp. 5

In Example 11, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 5 in separate baths for either 1 minute, 2 minutes, 3 minutes or 5 minutes with the individual bath pHs adjusted to 4.0 with Bulk Neutralizer® 10. Fifth, the panels were rinsed at ambient temperature with deionized water for 10 seconds. Sixth, one set of panels was dried at ambient temperature. The remaining panels were dried at 212° F. for 6 minutes. Seventh, all panels were exposed unpainted to 168 hours of neutral salt spray per ASTM B117. All panels met the requirements of MIL-DTL-81706B, Class 3 (i.e., no pitting was observed).

Example 12—Comp. 5

In Example 12, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 5 in separate baths for either 1 minute, 2 minutes, 3 minutes, or 5 minutes with the individual bath pHs adjusted to 4.0 with Bulk Neutralizer® 10. Fifth, the panels were rinsed at ambient temperature with deionized water for 10 seconds. Sixth, the panels were dried at 212° F. for 6 minutes. Seventh, all panels were exposed unpainted to 168 hours of neutral salt spray per ASTM B117. All panels met the requirements of MIL-DTL-81706B, Class 3 (i.e., no pitting was observed). In addition, all panels passed the wet tape adhesion test per MIL-DTL-81706B, Class 3.

Example 13—Comp. 5

In Example 13, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 5 for 5 minutes with the individual bath pHs adjusted to 4.0 with Bulk Neutralizer® 10. Fifth, the panels were rinsed at ambient temperature with deionized water for 10 seconds. Sixth, the panels were dried at 212° F. for 6 minutes. Seventh, all panels were exposed unpainted to 168 hours of neutral salt spray per ASTM B117. All panels met the requirements of MIL-DTL-81706B, Class 3 (i.e., no pitting was observed). The panels also met the contact resistance requirements of MIL-DTL-81706B Class 3 both before and after the 168 hours neutral salt spray exposure. Finally, all panels passed the wet tape adhesion test per MIL-DTL-81706B, Class 3.

Example 14—Comp. 4

In Example 14, 6061 alloy aluminum panels were treated via the following immersion process. First, the panels were cleaned with a 15 g/L treatment of Bulk Kleen® 737G for 5 minutes at 135-140° F. Second, the panels were rinsed at ambient temperature for 30 seconds. Third, the panels were rinsed with deionized water at ambient temperature for an additional 30 seconds. Fourth, separate panels were immersed at ambient temperature in a 3% v/v dilution of Comp. 4 for 6 minutes with the bath pH adjusted to 4.0 with Bulk Neutralizer® 10. Fifth, the panels were rinsed at ambient temperature with deionized water for 10 seconds. Sixth, the panels were dried for 8 minutes at temperature of 125° F. Seventh, all panels were exposed unpainted to 168 hours of neutral salt spray per ASTM B117. All panels met the requirements of MIL-DTL-81706B, Class 3 (i.e., no pitting was observed). In addition, all panels passed the contact resistance test before and after the salt spray test per MIL-DTL-81706B, Class 3.

Example 15—Comp. 6

In Example 15, 6061 alloy aluminum panels were treated via the following immersion process. First, the panels were cleaned with a 15 g/L treatment of Bulk Kleen® 737G for 5 minutes at 130° F. Second, the panels were rinsed at ambient temperature for 30 seconds. Third, the panels were rinsed with deionized water at ambient temperature for an additional 30 seconds. Fourth, separate panels were immersed at ambient temperature in a 2% v/v dilution of Comp. 6 for 5 minutes with the bath pH adjusted to 4.0 with Bulk Neutralizer® 10. Fifth, the panels were rinsed at ambient temperature with deionized water for 10 seconds. Sixth, the panels were dried for 8 minutes at ambient temperature. Seventh, all panels were exposed unpainted to 168 hours of neutral salt spray per ASTM B117. All panels met the requirements of MIL-DTL-81706B, Class 3 (i.e., no pitting was observed). In addition, all panels passed the contact resistance test before and after the salt spray test and the wet tape adhesion test per MIL-DTL-81706B, Class 3.

All wet tape adhesion and contact resistance tests were done by third party labs that are not affiliated with the applicant. In addition, the neutral salt spray tests used for Examples 13, 14, and 15 were done by third party labs that are not affiliated with the applicant.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges. It is also expressly intended that the steps of the methods of using the various compositions disclosed above are not restricted to any particular order.

What is claimed is:

1. A chromium-free aqueous treatment solution for coating metal surfaces, the solution consisting of:

water;

a compound of a Group IV-B element selected from a group consisting of fluorozirconic acid (as $H_2ZrF_6$) and fluorotitanic acid (as $H_2TiF_6$) or a mixture thereof; and ammonium metavandate.

2. The solution of claim 1, having from 0.01 to 5.99 wt % of fluorozirconic acid;

from 0.01 to 5.99 wt % of fluorotitanic acid; and from $1.0\times10^{-3}$ to $5.0\times10^{-1}$ wt. % ammonium vanadate.

3. The solution of claim 2, having 1.35 wt % fluorozirconic acid;

1.35 wt % fluorotitanic acid; and $2.0\times10^{-1}$ wt. % ammonium vanadate.

4. The solution of claim 1, wherein water comprises between 94.5 wt. % and 98.45 wt. % of the solution.

5. The solution of claim 4, wherein water comprises 97.1 wt % of the solution.

6. The solution of claim 1, wherein the solution is inorganic.

7. The solution of claim 1, wherein the solution has a pH greater than or equal to 3.

8. The solution of claim 7, wherein the solution has a pH of 3.0 to about 5.0.

9. The solution of claim 1, wherein the compound of a Group IV-B element is solely fluorozirconic acid.

10. The solution of claim 9, having from 0.01 to 5.99 wt % of fluorozirconic acid; and from $1.0\times10^{-3}$ to $5.0\times10^{-1}$ wt. % ammonium vanadate.

11. The solution of claim 9, having 1.35 wt. % fluorozirconic acid; and $2.0\times10^{-1}$ wt. % ammonium vanadate.

12. The solution of claim 9, having a pH greater than or equal to 3.

13. The solution of claim 12, wherein the solution has a pH of 3.0 to about 5.0.

14. The solution of claim 9, wherein water is between 94.5 wt. % and 98.45 wt. % of the solution.

15. The solution of claim 14, wherein water is 98.45 wt % of the solution.

* * * * *